US010773130B2

(12) United States Patent
Watanabe et al.

(10) Patent No.: US 10,773,130 B2
(45) **Date of Patent: *Sep. 15, 2020**

(54) MULTI-PIECE SOLID GOLF BALL

(71) Applicant: Bridgestone Sports Co., Ltd., Minato-ku, Tokyo (JP)

(72) Inventors: Hideo Watanabe, Chichibushi (JP); Akira Kimura, Chichibushi (JP); Jun Shindo, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/587,139

(22) Filed: Sep. 30, 2019

(65) Prior Publication Data

US 2020/0023240 A1 Jan. 23, 2020

Related U.S. Application Data

(63) Continuation-in-part of application No. 16/436,989, filed on Jun. 11, 2019, which is a continuation-in-part (Continued)

(30) Foreign Application Priority Data

Dec. 17, 2014 (JP) ..... 2014-255269

(51) Int. Cl.
*A63B 37/06* (2006.01)
*A63B 37/00* (2006.01)

(52) U.S. Cl.
CPC ..... *A63B 37/0075* (2013.01); *A63B 37/0063* (2013.01); *A63B 37/0065* (2013.01); (Continued)

(58) Field of Classification Search
CPC ..... A63B 37/0092; A63B 37/0075
(Continued)

(56) References Cited

U.S. PATENT DOCUMENTS 5,782,707 A 7/1998 Yamagishi et al.
6,520,871 B1 * 2/2003 Sullivan ..... A63B 37/0003 473/374

(Continued)

FOREIGN PATENT DOCUMENTS

JP 9-239068 A 9/1997
JP 2001-54588 A 2/2001

(Continued)

OTHER PUBLICATIONS

Communication dated Jan. 30, 2018 from the Japanese Patent Office in counterpart application No. 2014-255269.

*Primary Examiner* — Raeann Gorden
(74) *Attorney, Agent, or Firm* — Sughrue Mion, PLLC

(57) ABSTRACT

In a multi-piece solid golf ball having a core, a cover and an intermediate layer therebetween, the core, an intermediate layer-encased sphere and the ball have surface hardnesses which satisfy a specific relationship, and the intermediate layer and the cover have thicknesses which satisfy a specific relationship. Also, the core has a hardness profile in which the hardnesses at the core surface, core center, a position 5 mm from the core center, and a position midway between the surface and center of the core satisfy specific relationships. This golf ball, when used by mid- and high-level amateurs, enables the golfer to maintain an adequate distance on shots with a driver and achieve a good distance on iron shots, has a good spin performance on approach shots and has a good feel on impact. In addition, the ball has an excellent scuff resistance when struck with a grooved wedge.

13 Claims, 1 Drawing Sheet

Related U.S. Application Data of application No. 16/032,762, filed on Jul. 11, 2018, now Pat. No. 10,363,461, which is a continuation of application No. 15/464,579, filed on Mar. 21, 2017, now Pat. No. 10,046,207, which is a continuation-in-part of application No. 14/873,370, filed on Oct. 2, 2015, now Pat. No. 9,636,547.

(52) U.S. Cl.
CPC ..... *A63B 37/0068* (2013.01); *A63B 37/0077* (2013.01); *A63B 37/0081* (2013.01); *A63B 37/0084* (2013.01); *A63B 37/0092* (2013.01); *A63B 37/0033* (2013.01); *A63B 37/0043* (2013.01); *A63B 37/0045* (2013.01); *A63B 37/0062* (2013.01)

(58) Field of Classification Search
USPC ..... 473/373
See application file for complete search history.

(56) References Cited

U.S. PATENT DOCUMENTS

| | | | | |
|---|---|---|---|---|
| 6,592,470 | B2 | 7/2003 | Watanabe et al. | |
| 6,663,507 | B1 | 12/2003 | Watanabe et al. | |
| 6,702,695 | B1 | 3/2004 | Higuchi et al. | |
| 6,723,008 | B2 | 4/2004 | Higuchi et al. | |
| 6,739,986 | B2 | 5/2004 | Higuchi et al. | |
| 6,746,345 | B2 | 6/2004 | Higuchi et al. | |
| 6,814,676 | B2 | 11/2004 | Watanabe et al. | |
| 6,846,250 | B2 | 1/2005 | Higuchi et al. | |
| 7,959,524 | B2 | 6/2011 | Nanba et al. | |
| 9,061,181 | B2 | 6/2015 | Okabe | |
| 9,636,547 | B2 * | 5/2017 | Watanabe | A63B 37/0075 |
| 9,764,200 | B2 | 9/2017 | Watanabe et al. | |
| 10,046,207 | B2 * | 8/2018 | Watanabe | A63B 37/0081 |
| 10,363,461 | B2 * | 7/2019 | Watanabe | A63B 37/0081 |
| 2012/0264542 | A1 | 10/2012 | Matsuyama | |
| 2013/0123045 | A1 | 5/2013 | Watanabe et al. | |
| 2013/0296075 | A1 | 11/2013 | Kimura et al. | |
| 2013/0316851 | A1 | 11/2013 | Sajima et al. | |

FOREIGN PATENT DOCUMENTS

| | | | |
|---|---|---|---|
| JP | 2002-85587 | A | 3/2002 |
| JP | 2002-85588 | A | 3/2002 |
| JP | 2002-85589 | A | 3/2002 |
| JP | 2002-186686 | A | 7/2002 |
| JP | 2002-315848 | A | 10/2002 |
| JP | 2003-190330 | A | 7/2003 |
| JP | 2004-49913 | A | 2/2004 |
| JP | 2009-34505 | A | 2/2009 |
| JP | 2011-120898 | A | 6/2011 |
| JP | 2012-223286 | A | 11/2012 |
| JP | 2013-230362 | A | 11/2013 |
| JP | 2013-244165 | A | 12/2013 |

* cited by examiner

MULTI-PIECE SOLID GOLF BALL

CROSS-REFERENCE TO RELATED APPLICATION

This application is a continuation-in-part of copending application Ser. No. 16/436,989 filed on Jun. 11, 2019, which is a continuation-in-part of application Ser. No. 16/032,762 filed on Jul. 11, 2018 (now is U.S. Pat. No. 10,363,461), which is a continuation of application Ser. No. 15/464,579 filed on Mar. 21, 2017 (now is U.S. Pat. No. 10,046,207), which is a continuation-in-part of application Ser. No. 14/873,370 filed on Oct. 2, 2015 (now U.S. Pat. No. 9,636,547), the entire contents of which are hereby incorporated by reference.

BACKGROUND OF THE INVENTION

Field of the Invention

The present invention relates to a multi-piece solid golf ball of three or more pieces which has a core, an intermediate layer and a cover. The invention relates in particular to a multi-piece solid golf ball ideal for mid- and high-level amateur golfers, which ball, while retaining a good distance on shots with a driver (W #1) can achieve a superior distance even on shots with an iron, and thus is able to increase the enjoyability of the game.

Prior Art

Numerous golf balls which can achieve an excellent flight performance and spin properties when hit at high head speeds and can also provide a good feel at impact have hitherto been developed in order to address the needs of professional golfers and skilled amateurs. Of these, by focusing on the hardness profile in the core—which accounts for most of the ball volume, and designing the core interior hardness in various ways, a number of technical solutions that provide high-performance golf balls for professional golfers and skilled amateurs have been proposed.

Such technical solutions include those disclosed in the following publications relating to the core hardness profile: JP-A 9-239068, JP-A 2003-190330, JP-A 2004-049913, JP-A 2002-315848, JP-A 2001-54588, JP-A 2002-85588, JP-A 2002-85589, JP-A 2002-85587, JP-A 2002-186686, JP-A 2009-34505 and JP-A 2011-120898.

However, for mid- and high-level amateurs, whose head speeds are not as high as those of professional golfers, most balls, even when they are able to maintain an acceptable distance on good shots with a driver (W #1), fall short of what is desired in terms of other ball properties, such as the distance traveled on iron shots taken with, for example a middle iron. Also, when attempts have been made to obtain a superior distance performance not only on shots with a driver, but also on shots with an iron, the resulting balls have been unable to exhibit a sufficiently high spin performance on approach shots, and thus have fallen short as golf balls intended to enhance the enjoyability of the game. Accordingly, there exists a desire for the design and development of a golf ball which, by having a high level of performance attributes such as flight, spin performance on approach shots and feel, brings to the game of golf a high degree of enjoyability, and is thus capable of satisfying the needs of mid- and high-level amateur golfers.

It is therefore an object of this invention to provide a golf ball which, when used by mid- and high-level amateur golfers whose head speeds are not as high as those of professional golfers, enables them to maintain an acceptable distance on shots with a driver and also obtain a good distance on iron shots taken with, for, example, a middle iron, and moreover provides a good spin performance on approach shots and a good feel at impact.

SUMMARY OF THE INVENTION

As a result of extensive investigations, we have discovered that, in a multi-piece solid golf ball having a core, a cover and an intermediate layer therebetween, by making the cover hard on the inside and soft on the outside and making the intermediate layer somewhat hard, by also adjusting the relative thicknesses of the intermediate layer and the cover within a specific range, and moreover by forming the core, the intermediate layer and the cover as successive layers in such manner as, in the design of the core hardness profile and hardness gradient, to give the center portion of the core a flat or relatively gradual hardness gradient, to make the hardness gradient of the overall ball larger in degree than the hardness gradient at the core interior and to increase the resilience of the ball interior, the spin rate on full shots can be suppressed more than in conventional golf balls, thereby improving the distance—with the balance between the flight on shots with a driver (W #1) and the flight on shots with a middle iron in particular being good, and a good spin performance in the short game and a soft feel at impact can also be conferred. Hence, we have succeeded in developing a superior golf ball which, for the ordinary mid- or high-level amateur golfer in particular, enables a superior distance to be obtained on shots with an iron while maintaining a good distance on shots with a driver (W #1), and moreover is able to retain the spin performance on approach shots at a high level, thus providing good enjoyability in the game of golf. In addition, the golf ball of this invention also has an excellent resistance to damage of the cover surface (scuff resistance) when struck with a fully grooved wedge. As used herein, "mid- and high-level amateur" refers to amateur golfers having head speeds (HS) of generally from about 40 m/s to about 50 m/s, with a mid-level amateur golfer having a HS of generally 40 to 48 m/s and a high-level amateur golfer having a HS of generally 42 to 50 m/s.

Accordingly, the invention provides a multi-piece solid golf ball comprising a core, a cover and an intermediate layer therebetween, wherein the core, a sphere composed of the core and the intermediate layer which peripherally encases the core (intermediate layer-encased sphere), and the ball have respective surface hardnesses, expressed in terms of Shore D hardness, which satisfy the relationship ball surface hardness≤surface hardness of intermediate layer-encased sphere≥core surface hardness;

and the intermediate layer and the cover have respective thicknesses which satisfy the relationship (thickness of intermediate layer−thickness of cover) ≥0; and the core has a hardness profile which, expressed in terms of JIS-C hardness, satisfies the following relationships:

core center hardness (Cc)≤63,

22≥core surface hardness (Cs)−core center hardness (Cc),

5≥[hardness at a position 5 mm from core center (C5)−core center hardness (Cc)]>0, and

[core surface hardness (Cs)−core center hardness (Cc)]/[hardness at a position midway between core surface and core center (Cm)−core center hardness (Cc)]≤3.0; and the (initial velocity of intermediate layer-encased sphere−initial velocity of core) value is 0.20 m/s or above.

In a preferred embodiment of the multi-piece solid golf ball of the invention, the [hardness at a position midway between core surface and core center (Cm)−core center hardness (Cc)] value, expressed in terms of JIS-C hardness, is 6 or less.

In another preferred embodiment of the inventive golf ball, the [core surface hardness (Cs)−core center hardness (Cc)]/[hardness at a position 5 mm from core center (C5)−core center hardness (Cc)] value, is 4 or more.

In yet another preferred embodiment, the (core surface hardness−ball surface hardness) value, expressed in terms of Shore D hardness, is in the range of −10 to 2.

In still another preferred embodiment, the golf ball of the invention satisfies the relationship 0.7 mm≤E−B≤1.6 mm, wherein E is the deflection of the core when compressed under a final load of 1,275 N (130 kgf) from an initial load of 98 N (10 kgf) and B is the deflection of the ball when compressed under a final load of 1,275 N (130 kgf) from an initial load of 98 N (10 kgf).

In a further preferred embodiment, the initial velocities of the core, the intermediate layer-encased sphere and the ball satisfy the relationships:

−0.1 m/s≤ball initial velocity−core initial velocity≤1 m/s; and

−1.3 m/s ball initial velocity−initial velocity of intermediate layer-encased sphere≤−0.1 m/s.

In a still further preferred embodiment, the material of the intermediate layer includes an ionomer resin having a high acid content of at least 16 wt %.

In a more further preferred embodiment, the core is formed of a rubber composition containing the following ingredients (a) to (d):

(a) a base rubber, (b) a co-crosslinking agent which is an α,β-unsaturated carboxylic acid or a metal salt thereof or both, (c) a crosslinking initiator, and (d) a lower alcohol having a molecular weight below 200.

In the above embodiment, it is preferable for component (d) to be included in an amount, per 100 parts by weight of the base rubber (a), of from 0.5 to 5 parts by weight. Also, component (d) is preferably a monohydric, dihydric or trihydric alcohol. It is preferable in particular for component (d) to be butanol, glycerol, ethylene glycol or propylene glycol.

In a more further another preferred embodiment, it is preferable that the intermediate layer has a material hardness, expressed in terms of Shore D hardness, of at least 60. Also, it is preferable that the value obtained by subtracting the surface hardness of the intermediate layer-encased sphere from the surface hardness of the ball, expressed in terms of Shore D hardness, is −6 or below.

The golf ball of the invention, when used by mid- and high-level amateur golfers, enables the distance on shots with a driver to be satisfactorily maintained, achieves a good distance on iron shots such as with a middle iron, and moreover has a good spin performance on approach shots and a good feel at impact. In addition, this golf ball has an excellent resistance to damage of the cover surface (scuff resistance) when struck with a fully grooved wedge.

DESCRIPTION OF THE DIAGRAMS

DETAILED DESCRIPTION OF THE INVENTION

The objects, features and advantages of the invention will become more apparent from the following detailed description, taken in conjunction with the foregoing diagrams.

Figure 1:
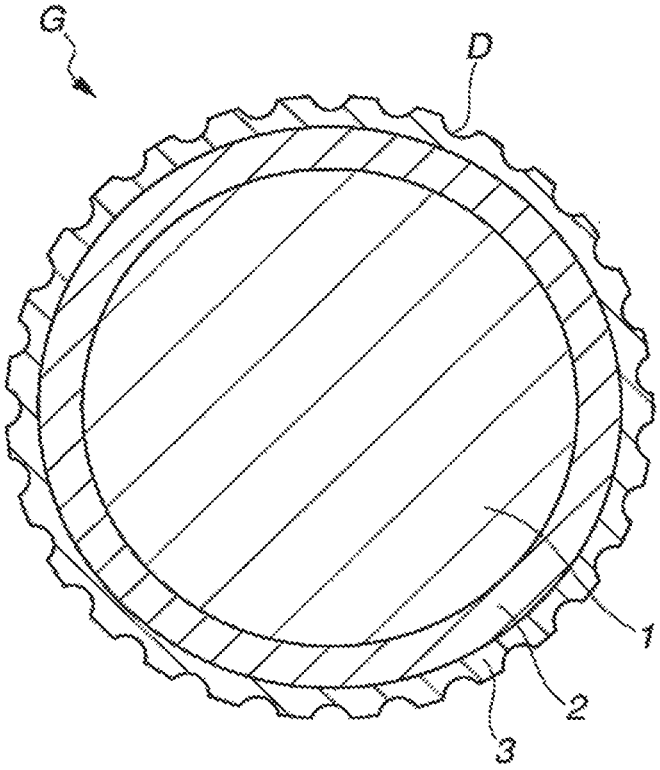
FIG. 1 is a schematic cross-sectional diagram showing an example of a golf ball structure according to the invention.

The multi-piece solid golf ball of the invention has, arranged in order from the inside of the golf ball: a solid core, an intermediate layer and a cover. Referring to FIG. 1, a golf ball G has a core 1, an intermediate layer 2 encasing the core 1, and a cover 3 encasing the intermediate layer 2. Numerous dimples D are generally formed on the surface of the cover 3 in order to enhance the aerodynamic properties. These layers are described in detail below.

The core may be formed using a known rubber composition. Although not particularly limited, preferred examples include rubber compositions formulated as described below.

The material forming the core may be one composed primarily of a rubber material. For example, the core may be formed using a rubber composition which includes, together with a base rubber, compounding ingredients such as co-crosslinking agents, organic peroxides, inert fillers, sulfur, antioxidants and organosulfur compounds.

In the practice of this invention, it is especially preferable to use a rubber composition containing the following ingredients (a) to (d):

(a) a base rubber, (b) a co-crosslinking agent which is an α,β-unsaturated carboxylic acid and/or a metal salt thereof, (c) a crosslinking initiator, and (d) a lower alcohol having a molecular weight below 200.

A polybutadiene is preferably used as the base rubber serving as component (a).

This polybutadiene may be one having a cis-1,4 bond content on the polymer chain of at least 60%, preferably at least 80 wt %, more preferably at least 90 wt %, and most preferably at least 95 wt %. When the content of cis-1,4 bonds among the bonds on the polybutadiene molecule is too low, the resilience may decrease.

A polybutadiene rubber differing from the above polybutadiene may also be included in the base rubber. In addition, styrene-butadiene rubber (SBR), natural rubber, polyisoprene rubber, ethylene-propylene-diene rubber (EPDM) or the like may be included as well. These may be used singly, or two or more may be used in combination.

The co-crosslinking agent serving as component (b) above is an α,β-unsaturated acid and/or a metal salt thereof. Illustrative examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by the foregoing unsaturated carboxylic acids which have been neutralized with the desired metal ions. Illustrative examples include the zinc salts and magnesium salts of methacrylic acid and acrylic acid. The use of zinc acrylate is especially preferred. These unsaturated carboxylic acids and/or metal salts thereof are included in an amount per 100 parts by weight of the base rubber which is preferably at least 10 parts by weight, more preferably at least 15 parts by weight, and even more preferably at least 20 parts by weight. The upper limit is preferably not more than 45 parts by weight, more preferably not more than 43 parts by weight, and even more preferably not more than 41 parts by weight.

An organic peroxide is preferably used as the crosslinking initiator serving as component (c). Specifically, the use of an organic peroxide having a relatively high thermal decomposition temperature is preferred. For example, an organic peroxide having an elevated one-minute half-life temperature of from about 165° C. to about 185° C., such as a dialkyl peroxide, may be used. Illustrative examples of dialkyl peroxides include dicumyl peroxide ("Percumyl D," from NOF Corporation), 2,5-dimethyl-2,5-di(t-butylperoxy) hexane ("Perhexa 25B," from NOF Corporation), and di(2-t-butylperoxyisopropyl)benzene ("Perbutyl P," from NOF Corporation). Preferred use can be made of dicumyl peroxide. These may be used singly or two or more may be used in combination. The half-life is one indicator of the organic peroxide decomposition rate, and is expressed as the time required for the original organic peroxide to decompose and the active oxygen content therein to fall to one-half. The vulcanization temperature for the core-forming rubber composition is generally in the range of 120° C. to 190° C. Within this range, the thermal decomposition of high-temperature organic peroxides having a one-minute half-life temperature of about 165° C. to about 185° C. is relatively slow. With the rubber composition of the invention, by regulating the amount of free radicals generated, which increases as the vulcanization time elapses, a crosslinked rubber core having a specific internal hardness profile is obtained.

The crosslinking initiator is included in an amount, per 100 parts by weight of the base rubber, of preferably at least 0.1 part by weight, more preferably at least 0.2 part by weight, and even more preferably at least 0.3 part by weight. The upper limit is preferably not more than 5.0 parts by weight, more preferably not more than 4.0 parts by weight, even more preferably not more than 3.0 parts by weight, and most preferably not more than 2.0 parts by weight. Including too much may make the core too hard, possibly resulting in an unpleasant feel at impact and greatly lowering the durability to cracking. On the other hand, when too little is included, the core may become too soft, possibly resulting in an unpleasant feel at impact and greatly lowering productivity.

Next, component (d) is a lower alcohol having a molecular weight below 200. Here, "alcohol" refers to a substance having one or more alcoholic hydroxyl group; substances obtained by the polycondensation of polyhydric alcohols having 20 or more hydroxyl groups are also included among such alcohols. "Lower alcohol" refers to an alcohol having a small number of carbon atoms; that is, an alcohol having a small molecular weight. By including this lower alcohol in the rubber composition, when the rubber composition is vulcanized (cured), a cured rubber product (core) having the desired core hardness profile can be obtained and spin rate reduction of the ball when struck is fully achieved, enabling the ball to have an excellent flight performance.

A monohydric, dihydric or trihydric alcohol (an alcohol having one, two or three alcoholic hydroxyl groups) is especially preferred as the lower alcohol. Specific examples include, but are not limited to, methanol, ethanol, propanol, butanol, ethylene glycol, diethylene glycol, propylene glycol, dipropylene glycol, tripropylene glycol and glycerol. These have a molecular weight below 200, preferably below 150, and more preferably below 100. When the molecular weight is large, i.e., when the number of carbons is high, the desired core hardness profile is not obtained and a reduced ball spin rate on impact cannot be fully achieved.

The amount of component (d) included per 100 parts by weight of the base rubber serving as component (a) is preferably at least 0.1 part by weight, and more preferably at least 0.5 part by weight. The upper limit value is preferably 10 parts by weight or less, more preferably 6 parts by weight or less, and even more preferably 3 parts by weight or less. When the amount of component (d) included is too high, the hardness may decrease and the desired feel, durability and rebound may not be obtained. When the amount included is too low, the desired core hardness profile may not be obtained and a reduced ball spin rate on impact may not be fully achieved.

Aside from above components (a) to (d), various other additives, such as fillers, antioxidants and organosulfur compounds, may be included, provided that doing so does not detract from the advantageous effects of the invention.

Ingredients other than components (a) to (d), such as water, sulfur, organosulfur compounds, fillers and antioxidants, may be optionally included in the rubber composition.

Water may be included in a rubber composition. In this case, the water serving is not particularly limited, and may be distilled water or tap water. The use of distilled water which is free of impurities is especially preferred. The amount of water included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight.

By including a suitable amount of such water, the moisture content in the rubber composition before vulcanization becomes preferably at least 1,000 ppm, and more preferably at least 1,500 ppm. The upper limit is preferably not more than 8,500 ppm, and more preferably not more than 8,000 ppm. When the water content of the rubber composition is too small, it may be difficult to obtain a suitable crosslink density and tan δ, which may make it difficult to mold a golf ball having little energy loss and a reduced spin rate. On the other hand, when the water content of the rubber composition is too large, the core may become too soft, which may make it difficult to obtain a suitable core initial velocity.

It is also possible to include water directly in the rubber composition. The following methods (i) to (iii) may be employed to include water:

(i) applying steam or ultrasonically applying water in the form of a mist to some or all of the rubber composition (compounded material);
(ii) immersing some or all of the rubber composition in water;
(iii) letting some or all of the rubber composition stand for a fixed period of time in a high-humidity environment in a place where the humidity can be controlled, such as a constant humidity chamber.

As used herein, "high-humidity environment" is not particularly limited, so long as it is an environment capable of moistening the rubber composition, although a humidity of from 40 to 100% is preferred.

Alternatively, the water may be worked into a jelly state and added to the above rubber composition. Or a material obtained by first supporting water on a filler, unvulcanized rubber, rubber powder or the like may be added to the rubber composition. In such a form, the workability is better than when water is directly added to the composition, enabling the golf ball production efficiency to be enhanced. The type of material in which a given amount of water has been included, although not particularly limited, is exemplified by fillers, unvulcanized rubbers and rubber powders in which sufficient water has been included. The use of a material which undergoes no loss of durability or resilience is especially preferred. The water content of the above material is preferably at least 5 wt %, and more preferably at least 10 wt %. The upper limit is preferably not more than 99 wt %, and more preferably not more than 95 wt %.

A metal monocarboxylate may be used instead of the water. Metal monocarboxylates, in which the carboxylic acid is presumably coordination-bonded to the metal, are distinct from metal dicarboxylates such as zinc diacrylate of the formula $(CH_2{=}CHCOO)_2Zn$. A metal monocarboxylate introduces water into the rubber composition by way of a dehydration/condensation reaction, and thus provides an effect similar to that of water. Moreover, because a metal monocarboxylate can be added to the rubber composition as a powder, the operations can be simplified and uniform dispersion within the rubber composition is easy. In order to carry out the above reaction effectively, a monosalt is required. The amount of metal monocarboxylate included per 100 parts by weight of the base rubber is preferably at least 1 part by weight, and more preferably at least 3 parts by weight. The upper limit in the amount of metal monocarboxylate included is preferably not more than 60 parts by weight, and more preferably not more than 50 parts by weight. When the amount of metal monocarboxylate included is too small, it may be difficult to obtain a suitable crosslink density and tan δ, as a result of which a sufficient golf ball spin rate-lowering effect may not be achievable. On the other hand, when too much is included, the core may become too hard, as a result of which it may be difficult for the ball to maintain a suitable feel at impact.

The carboxylic acid used may be, for example, acrylic acid, methacrylic acid, maleic acid, fumaric acid or stearic acid. Examples of the substituting metal include sodium, potassium, lithium, zinc, copper, magnesium, calcium, cobalt, nickel and lead, although the use of zinc is preferred. Illustrative examples of the metal monocarboxylate include zinc monoacrylate and zinc monomethacrylate, with the use of zinc monoacrylate being especially preferred.

The rubber composition containing the various above ingredients is prepared by mixture using a typical mixing apparatus, such as a Banbury mixer or a roll mill. When this rubber composition is used to mold the core, molding may be carried out by compression molding or injection molding using a specific mold for molding cores. The resulting molded body is then heated and cured under temperature conditions sufficient for the organic peroxide and co-cross-linking agent included in the rubber composition to act, thereby giving a core having a specific hardness profile. The vulcanization conditions in this case, while not subject to any particular limitation, are generally set to a temperature of from about 100 to about 200° C., and especially 130 to 170° C., and a time of from 10 to 40 minutes, and especially 12 to 20 minutes.

The core diameter, although not particularly limited, may be set to from 35 to 40 mm. In this case, the lower limit is preferably at least 36 mm, more preferably at least 37 mm, and even more preferably at least 37.3 mm. The upper limit may be set to preferably not more than 39 mm, more preferably not more than 38.5 mm, and even more preferably not more than 37.9 mm.

The core has a center hardness (Cc), expressed in terms of JIS-C hardness, which is not more than 63. The upper limit may be set to preferably not more than 61, and more preferably not more than 59. The lower limit, although not particularly limited, may be set to preferably at least 50, more preferably at least 53, and even more preferably at least 55. When this value is too large, the spin rate may rise excessively, as a result of which a good distance may not be obtained, or the feel at impact may be too hard. On the other hand, when this value is too small, the durability to cracking under repeated impact may worsen or the feel at impact may become too soft.

The core has a surface hardness (Cs), expressed in terms of JIS-C hardness, which, although not particularly limited, may be set to preferably at least 72, more preferably at least 76, and even more preferably at least 80. The upper limit may be set to preferably not more than 96, more preferably not more than 92, and even more preferably not more than 88. When this value is too large, the feel at impact may become hard or the durability to cracking under repeated impact may worsen. On the other hand, when this value is too small, the spin rate may rise excessively or the rebound may decrease, as a result of which a good distance may not be obtained.

As used herein, the center hardness (Cc) refers to the hardness measured at the center of the cross-section obtained by cutting the core in half through the center, and the surface hardness (Cs) refers to the hardness measured at the spherical surface of the core.

The hardness difference between the core center and the core surface is optimized so as to make the hardness difference between the inside and outside of the core large. The core surface hardness (Cs)−core center hardness (Cc) value, expressed in terms of JIS-C hardness, which, although not particularly limited, may be set to preferably at least 22, more preferably at least 23, and even more preferably at least 25. The upper limit may be set to preferably not more than 35, more preferably not more than 30, and even more preferably not more than 28. When the hardness difference is too small, the spin rate may rise excessively, as a result of which a good distance may not be obtained. When the hardness difference is too large, the initial velocity on actual shots may be low, possibly resulting in a poor distance, or the durability to cracking on repeated impact may be poor.

The core has a cross-sectional hardness at a position midway between the center and surface of the core (Cm), expressed in terms of JIS-C hardness, which, although not particularly limited, may be set to preferably at least 53, more preferably at least 56, and even more preferably at least 58. The upper limit may be set to preferably not more than 69, more preferably not more than 66, and even more preferably not more than 64. When this value is too large, the spin rate may rise excessively, as a result of which a good distance may not be achieved, or the feel of the ball may be hard. On the other hand, when the value is too small, the durability to cracking on repeated impact may worsen or the feel may be too soft.

The core has a hardness at a position 5 mm from the core center (C5), expressed in terms of JIS-C hardness, which, although not particularly limited, may be set to preferably at least 53, more preferably at least 56, and even more preferably at least 58. The upper limit may be set to preferably not more than 67, more preferably not more than 64, and even more preferably not more than 62. When this value is too large, the spin rate may rise excessively, as a result of which a good distance may not be achieved, or the feel at impact may be too hard. On the other hand, when the value is too small, the durability to cracking on repeated impact may worsen or the feel may be too soft.

The relationship between the hardness at a position 5 mm from the core center (C5) and the core center hardness (Cc) is optimized in a specific range so that the hardness at the center portion of the core is relatively flat or so as to make the hardness gradient near this portion relatively gradual. That is, the value C5−Cc expressed in terms of JIS-C hardness, although not particularly limited, is preferably larger than 0, more preferably at least 1, and even more preferably at least 2. The upper limit is preferably not more than 5, more preferably not more than 4, and even more preferably not more than 3. Outside of this range, the spin rate on full shots increases, as a result of which the intended distance may not be obtained, or the durability to cracking on repeated impact may worsen.

The value of the core center hardness (Cc) subtracted from the hardness (Cm) at a position midway between the core surface and core center is optimized in a specific range so as to make the hardness gradient at the core interior relatively gradual. That is, the Cm−Cc value expressed in terms of JIS-C hardness, although not particularly limited, may be set to preferably more than 2, and more preferably at least 3. The upper limit may be set to preferably 6 or less. Outside of this range, the spin rate on full shots may rise, as a result of which the intended distance may not be obtained, or the durability to cracking under repeated impact may worsen.

The value obtained by subtracting the core hardness at a position midway between the core surface and core center (Cm) from the core surface hardness (Cs), that is, the value Cs−Cm, expressed in terms of JIS-C hardness, although not particularly limited, may be set to preferably at least 14, more preferably at least 17, and even more preferably at least 20. The upper limit may be set to preferably 31 or less, more preferably 28 or less, and even more preferably 25 or less. Outside of this range, the spin rate on full shots may rise, as a result of which the intended distance may not be obtained, or the durability to cracking on repeated impact may worsen.

The [core surface hardness (Cs)−core center hardness (Cc)]/[hardness at a position 5 mm from core center (C5)−core center hardness (Cc)] value is optimized in a specific range in order to make the gradient at the core exterior larger in degree than the gradient at the core interior. That is, this value, although not particularly limited, may be set to preferably at least 4, more preferably at least 6, and even more preferably at least 8. The upper limit may be set to preferably 13 or less, more preferably 11 or less, and even more preferably 9 or less. Outside of this range, the spin rate on full shots may increase, as a result of which the intended distance may not be obtained, or the durability to cracking on repeated impact may worsen.

Although the degree of the gradient at the core interior is relatively gradual, in order to make the overall gradient large, the [core surface hardness (Cs)−core center hardness (Cc)]/[hardness at a position midway between the core surface and core center (Cm)−core center hardness (Cc)] value is optimized in a specific range. That is, this value, although not particularly limited, may be set to preferably at least 3, more preferably at least 4, and even more preferably at least 5. The upper limit may be set to preferably 13 or less, more preferably 11 or less, and even more preferably 9 or less. Outside of this range, the spin rate on full shots may increase, as a result of which the intended distance may not be obtained, or the durability to cracking on repeated impact may worsen.

The core has a deflection when compressed under a final load of 1,275 N (130 kgf) from an initial load of 98 N (10 kgf) which, although not particularly limited, is preferably at least 2.5 mm, more preferably at least 3.0 mm, and even more preferably at least 3.5 mm. The upper limit may be set to preferably 6.5 mm or less, more preferably 5.5 mm or less, and even more preferably 4.5 mm or less. If the core is harder than this range (i.e., if the deflection is too small), the spin rate may rise excessively, as a result of which the ball may not achieve a good distance, or the feel at impact may be too hard. On the other hand, if the core is softer than this range (i.e., if the deflection is too large), the rebound may be too small, as a result of which the ball may not achieve a good distance, the feel at impact may be too soft, or the durability to cracking under repeated impact may worsen.

Next, the resin material used in the intermediate layer is described. The intermediate layer material is not particularly limited, although various types of thermoplastic resin materials may be preferably used. In particular, in order to be able to fully achieve the desired effects of the invention, it is preferable to use a high-resilience resin material as the intermediate layer material. For example, the use of an ionomer resin material, a resin material including an ionomer resin having a high acid content, or the subsequently described highly neutralized resin material is preferred. Illustrative examples of ionomer resin materials include sodium-neutralized ionomer resins available under the trade names Himilan 1605, Himilan 1601 and Surlyn 8120, and zinc-neutralized ionomer resins such as Himilan 1557 and Himilan 1706. These may be used singly, or two or more may be used in combination.

With respect to a resin material including an ionomer resin having a high acid content, the acid content is preferably at least 16 wt %, more preferably at least 17 wt % and even more preferably at least 18 wt %. Illustrative examples of such ionomers resin having a high acid content include AM 7318, AM7315, AM7317, Surlyn9150, Surlyn8150, Surlyn6120 and Surlyn8220.

It is especially preferable for the intermediate layer material to be in a form that is composed primarily of, in admixture, a zinc-neutralized ionomer resin and a sodium-neutralized ionomer resin. The compounding ratio thereof, expressed as the weight ratio "zinc-neutralized ionomer resin/sodium-neutralized ionomer resin," is typically from 25/75 to 75/25, preferably from 35/65 to 65/35, and more preferably from 45/55 to 55/45. If the zinc-neutralized ionomer and the sodium-neutralized ionomer are not included within this range, the resilience may be too low, as a result of which the intended distance may not be obtained, in addition to which the durability to cracking on repeated impact at normal temperatures may worsen and the durability to cracking at low (subzero) temperatures may also worsen.

The structure of the intermediate layer is not limited to one layer; where necessary, two or more intermediate layers of the same or different types may be formed within the above-indicated range. By forming a plurality of intermediate layers, the spin rate on shots with a driver can be reduced, enabling the distance traveled by the ball to be increased even further. Also, the spin properties and feel at the time of impact can be further improved.

The intermediate layer has a material hardness, expressed in terms of Shore D hardness, which, although not particularly limited, is preferably at least 58, more preferably at least 59, and even more preferably at least 60, with the upper limit being preferably 68 or less, more preferably 65 or less, and even more preferably 62 or less. At a material hardness lower than this range, the ball may be too receptive to spin on full shots, as a result of which an increased distance may not be achieved. On the other hand, at a material hardness higher than this range, the durability to cracking on repeated impact may worsen, or the feel at impact on actual shots with a putter or on short approaches may be too hard.

The sphere obtained by encasing the core with the intermediate layer (referred to below as the "intermediate layer-encased sphere") has a surface hardness, expressed in terms of Shore D hardness, which is preferably at least 65, more preferably at least 66, and even more preferably at least 67, with the upper limit being preferably 75 or less, more preferably 72 or less, and even more preferably 69 or less. At a surface hardness lower than this range, the ball may be too receptive to spin on full shots, as a result of which an increased distance may not be obtained. On the other hand, at a surface hardness higher than this range, the durability to cracking on repeated impact may worsen, or the feel at impact on actual shots with a putter or on short approaches may be too hard.

The intermediate layer has a thickness which, although not particularly limited, is preferably at least 0.9 mm, more preferably at least 1.2 mm, and even more preferably at least 1.5 mm, with the upper limit being preferably 2.4 mm or less, more preferably 2.1 mm or less, and even more preferably 1.8 mm or less. Outside of this range, the spin rate-lowering effect on shots with a W #1 may be inadequate, as a result of which an increased distance may not be obtained. Also, at a thickness that is smaller than this range, the durability to cracking on repeated impact may worsen. It is desirable for the intermediate layer to be formed so as to be thicker than the subsequently described cover (outermost layer).

It is advantageous to abrade the surface of the intermediate layer in order to increase adhesion with the polyurethane that is preferably used in the subsequently described cover (outermost layer). In addition, it is desirable to apply a primer (adhesive) to the surface of the intermediate layer following such abrasion treatment or to add an adhesion reinforcing agent to the intermediate layer material.

The intermediate layer material has a specific gravity which is typically less than 1.1, preferably from 0.90 to 1.05, and more preferably from 0.93 to 0.99. Outside of this range, the rebound becomes small, as a result of which a good distance may not be obtained, or the durability to cracking on repeated impact may worsen.

Next, the cover, which corresponds to the outermost layer of the ball, is described. The material of the cover (outermost layer) is not particularly limited, although the use of various types of thermoplastic resin material is preferred. For reasons having to do with controllability and scuff resistance, it is preferable to use a urethane resin as the cover material of the invention. In particular, from the standpoint of the mass productivity of manufactured golf balls, it is preferable to use a cover material composed primarily of a thermoplastic polyurethane, with formation more preferably being carried out using a resin blend composed primarily of (P) a thermoplastic polyurethane and (Q) a polyisocyanate compound.

In the thermoplastic polyurethane composition containing above components P and Q, to improve the ball properties even further, a necessary and sufficient amount of unreacted isocyanate groups should be present in the cover resin material. Specifically, it is recommended that the combined weight of above components P and Q be at least 60%, and more preferably at least 70%, of the weight of the overall cover layer. Components P and Q are described below in detail.

The thermoplastic polyurethane (P) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, an aliphatic diol having 2 to 12 carbons is preferred, and 1,4-butylene glycol is more preferred, as the chain extender.

Any polyisocyanate compound hitherto employed in the art relating to thermoplastic polyurethanes may be advantageously used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reaction during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component P. Illustrative examples include Pandex T-8295, T-8290, T-8283 and T-8260 (all from DIC Bayer Polymer, Ltd.).

Although not an essential ingredient, a thermoplastic elastomer other than the above thermoplastic polyurethane may be included as an additional component together with above components P and Q. By including this component R in the above resin blend, a further improvement in the flowability of the resin blend can be achieved and the properties required of a golf ball cover material, such as resilience and scuff resistance, can be enhanced.

The relative proportions of above components P, Q and R are not particularly limited. However, to fully elicit the desirable effects of the invention, the weight ratio P:Q:R is preferably from 100:2:50 to 100:50:0, and more preferably from 100:2:50 to 100:30:8.

In addition to the ingredients making up the thermoplastic polyurethane, various additives may be optionally included in the above resin blend. For example, pigments, dispersants, antioxidants, light stabilizers, ultraviolet absorbers and internal mold lubricants may be suitably included.

The manufacture of multi-piece solid golf balls in which the above-described core, intermediate layer and cover (outermost layer) are formed as successive layers may be carried out by a customary method such as a known injection-molding process. For example, a multi-piece golf ball may be obtained by placing a molded and vulcanized product composed primarily of a rubber material as the core in a given injection mold, injecting an intermediate layer material over the core to give an intermediate sphere, and subsequently placing the resulting sphere in another injection mold and injection-molding a cover (outermost layer) material over the sphere. Alternatively, a cover may be formed over the intermediate layer by a method that involves encasing the intermediate sphere with a cover (outermost layer). For example, the intermediate sphere may be enclosed within two half-cups that have been pre-molded into hemispherical shapes, and molding then carried out under applied heat and pressure.

The cover (outermost layer) has a material hardness, expressed in terms of Shore D hardness, which, although not particularly limited, is preferably at least 35, more preferably at least 40, and even more preferably at least 47, with the upper limit being preferably 60 or less, more preferably 56 or less, and even more preferably 53 or less.

The cover (outermost layer)-encased sphere, i.e., the ball, has a surface hardness, expressed in terms of Shore D hardness, which is preferably at least 41, more preferably at least 46, and even more preferably at least 53, with the upper limit being preferably 66 or less, more preferably 62 or less, and even more preferably 59 or less. At a ball surface hardness lower than this range, the spin rate on shots with a W #1 may rise, resulting in poor distance. On the other hand, at a ball surface hardness higher than this range, the spin rate on approach shots may be inadequate, resulting in a poor controllability.

The cover (outermost layer) has a thickness which, although not particularly limited, is preferably at least 0.3 mm, more preferably at least 0.45 mm, and even more preferably at least 0.6 mm, with the upper limit being preferably 1.2 mm or less, more preferably 1.0 mm or less, and even more preferably 0.9 mm or less. At a cover thickness larger than this range, the rebound on W #1 shots and on approach shots may be inadequate and the spin rate may be too high, as a result of which a good distance may not be obtained. On the other hand, at a cover thickness smaller than this range, the scuff resistance may be poor or the ball may not be receptive to spin on approach shots, resulting in poor controllability.

The golf ball of the invention preferably satisfies also the following conditions.

(1) Relationship Between Surface Hardness of Ball and Surface Hardness of Intermediate Layer-Encased Sphere In order for the ball to have a structure in which the cover is hard on the inside and soft on the outside and the intermediate layer is hard, it is critical for the surface hardnesses of the ball and the intermediate layer-encased sphere to satisfy the relationship:

surface hardness of ball≤surface hardness of intermediate layer-encased sphere.

That is, the value obtained by subtracting the surface hardness of the intermediate layer-encased sphere from the surface hardness of the ball, expressed in terms of Shore D hardness, is preferably −22 or above, more preferably −18 or above, and further preferably −14 or above, with the upper limit being preferably −6 or below, more preferably −8 or below, and further preferably −10 or below. When this value is too large, the spin rate on full shots may rise excessively, as a result of which the intended distance may not be obtained, or the cover becomes hard, giving the ball an inadequate spin rate in the short game, as a result of which the controllability may be poor. On the other hand, when this value is too small, the cover may become too soft, leading to excessive spin on full shots, or the initial velocity may be too low, as a result of which the intended distance may not be achieved.

(2) Relationship Between Thicknesses of Intermediate Layer and Cover

The relative thicknesses of the intermediate layer and the cover must be set in a specific range. That is, the value obtained by subtracting the cover thickness from the intermediate layer thickness must be at least 0 mm, and is preferably at least 0.2 mm, and more preferably at least 0.4 mm, with the upper limit being preferably 2.0 mm or less, more preferably 1.5 mm or less, and even more preferably 1.0 mm or less. When this value is too large, the feel at impact may become too hard or the core may become too soft, resulting in a poor durability to cracking on repeated impact. On the other hand, when this value is too small, the spin rate on full shots may become too high, as a result of which the intended distance may not be obtained.

(3) Relationship Between Initial Velocities of Ball and Core

In order for the ball interior to have a relatively high resilience, the relationship between the initial velocities of the ball and the core are preferably adjusted within a specific range. That is, the value obtained by subtracting the core initial velocity from the ball initial velocity is preferably −1.0 m/s or above, more preferably −0.8 m/s or above, and even more preferably −0.6 m/s or above, with the upper limit being preferably −0.1 m/s or below, more preferably −0.2 m/s or below, and even more preferably −0.3 m/s or below. When this value is too large, the cover becomes hard and the scuff resistance may worsen, or the core initial velocity may be too low and the ball initial velocity may also be low, as a result of which the intended distance may not be obtained. On the other hand, when this value is too small, the ball initial velocity may become too high and may not conform to the R&A Rules of Golf, or the cover resilience may become too low, which may result in poor separation of the ball from the club in the short game. Measurement of the initial velocities of the respective spheres is carried out with the measurement apparatus and under the measurement conditions described below in the Examples section.

(4) Relationship Between Deflections of Core and Ball Under Specific Loading

Letting E be the deflection of the core when compressed under a final load of 1,275 N (130 kgf) from an initial load of 98 N (10 kgf) and B be the deflection of the ball when compressed under a final load of 1,275 N (130 kgf) from an initial load of 98 N (10 kgf), the value E−B is preferably at least 0.7 mm, more preferably at least 0.8 mm, and even more preferably at least 0.9 mm, with the upper limit being preferably 1.6 mm or less, more preferably 1.5 mm or less, and even more preferably 1.4 mm or less. When this value is too large, the durability to cracking on repeated impact may worsen, or the initial velocity of the ball on full shots may decrease, as a result of which the intended distance may not be obtained. On the other hand, when this value is too small, the spin rate on full shots may become too high, as a result of which the intended distance may not be obtained.

(5) Relationship Between Initial Velocities of Ball and Intermediate Layer-Encased Sphere The relationship between the initial velocities of the ball and the intermediate layer-encased sphere is preferably adjusted within a specific range in order to give the interior of the ball a relatively high resilience. That is, the relationship between the initial velocity of the ball and the initial velocity of the intermediate layer-encased sphere is such that the value obtained by subtracting the initial velocity of the intermediate layer-encased sphere from the initial velocity of the ball is preferably −1.3 m/s or above, more preferably −1.1 m/s or above, and more preferably −0.9 m/s or above, with the upper limit being preferably −0.1 m/s or below, more preferably −0.3 m/s or below, and even more preferably −0.5 m/s or below. When this value is too large, the cover may become too hard, resulting in a poor scuff resistance, or the initial velocities of the various layer-encased spheres at the ball interior may be too low and the ball initial velocity may also be low, as a result of which the intended distance may not be obtained. On the other hand, when this value is too small, the ball initial velocity may become too high, falling outside the prescribed range according to the R&A Rules of Golf, or the cover resilience may be too low, which may result in poor separation of the ball from the club in the short game. Measurement of the initial velocities of the respective spheres is carried out with the measurement apparatus and under the measurement conditions described below in the Examples section.

(6) Relationship Between Surface Hardnesses of Intermediate Layer-Encased Sphere and Core The intermediate layer is made relatively hard and the relationship between the surface hardnesses of the intermediate layer-encased sphere and the core is optimized within a specific range. That is, the value obtained by subtracting the surface hardness of the core from the surface hardness of the intermediate layer-encase sphere, expressed in terms of Shore D hardness, is preferably 0 or more, more preferably 1 or more, and even more preferably 3 or more, with the upper limit being preferably 20 or less, more preferably 18 or less, and even more preferably 16 or less. When this value is too large, the durability to cracking under repeated impact may worsen, or the feel at impact may worsen, and the initial velocity on full shots may be low, as a result of which the intended distance may not be obtained. On the other hand, when this value is too small, the spin rate on full shots may be too high, as a result of which the intended distance may not be obtained.

(7) Relationship Between Initial Velocities of Intermediate Layer-Encased Sphere and Core The intermediate layer resin material is given a good resilience and the relationship between the initial velocities of the intermediate layer-encased sphere and the core is optimized within a specific range. That is, the value obtained by subtracting the initial velocity of the core from the initial velocity of the intermediate layer-encased sphere is set to 0.2 m/s or above, preferably 0.3 m/s or above, and more preferably 0.4 m/s or above. When this value is too small, the spin rate on full shots may become high, as a result of which the intended distance may not be obtained, or the initial velocity of the ball may become low, as a result of which the intended distance may not be obtained. Measurement of the initial velocities of the respective spheres is carried out with the measurement apparatus and under the measurement conditions described below in the Examples section.

(8) Relationship Between Deflections of Core and Intermediate Layer-Encased Sphere Under Specific Loading The relationship between the deflections of the core and the intermediate layer-encased sphere under specific loading are optimized within a specific range. That is, letting E be the deflection of the core when compressed under a final load of 1,275 N (130 kgf) from an initial load of 98 N (10 kgf) and M be the deflection of the intermediate layer-encased sphere when compressed under a final load of 1,275 N (130 kgf) from an initial load of 98 N (10 kgf), the value E−M is preferably at least 0.4 mm, more preferably at least 0.5 mm, and even more preferably at least 0.6 mm, with the upper limit being preferably 1.5 mm or less, more preferably 1.3 mm or less, and even more preferably 1.1 mm or less. When this value is too large, the durability to cracking on repeated impact may worsen, or the initial velocity of the ball on full shots may decrease, as a result of which the intended distance may not be obtained. On the other hand, when this value is too small, the spin rate on full shots may become too high, as a result of which the intended distance may not be obtained.

Numerous dimples may be formed on the outer surface of the cover layer. The number of dimples arranged on the cover surface, although not particularly limited, is preferably at least 280, more preferably at least 300, and even more preferably at least 320, with the upper limit being preferably not more than 360, more preferably not more than 350, and even more preferably not more than 340. If the number of dimples is larger than this range, the ball trajectory becomes lower, as a result of which the distance may decrease. On the other hand, if the number of dimples is too small, the ball trajectory becomes higher, as a result of which a good distance may not be achieved.

The dimple shapes that are used may be of one type or a combination of two or more types selected from among circular shapes, various polygonal shapes, dewdrop shapes and oval shapes. For example, when circular dimples are used, the dimple diameter may be set to at least about 2.5 mm and up to about 6.5 mm, and the dimple depth may be set to at least 0.08 mm and up to about 0.30 mm.

In order to be able to fully manifest the aerodynamic properties, it is desirable for the surface coverage ratio of dimples on the spherical surface of the golf ball, i.e., the ratio SR of the sum of the individual dimple surface areas, each defined by the flat plane circumscribed by the edge of a dimple, with respect to the spherical surface area of the ball were it to have no dimples thereon, to be set to at least 60% and up to 90%. Also, in order to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and up to 0.80. Moreover, it is preferable for the ratio VR of the sum of the spatial volumes of the individual dimples, each formed below the flat plane circumscribed by the edge of a dimple, with respect to the volume of the ball sphere were the ball surface to have no dimples thereon, to be set to at least 0.6% and up to 1.0%. Outside of the above ranges in these respective values, the resulting trajectory may not enable a good distance to be obtained, and so the ball may fail to travel a fully adequate distance.

The multi-piece solid golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 to 4, Comparative Examples 1 to 8

Solid cores for the respective Examples of the invention and Comparative Examples were produced by preparing the rubber compositions shown in Table 1 below, then molding and vulcanizing the compositions under the vulcanization conditions shown in the same table.

TABLE 1

| Core formulations | | Example | | | | Comparative Example | | | | | | | |
|---|---|---|---|---|---|---|---|---|---|---|---|---|---|
| (pbw) | | 1 | 2 | 3 | 4 | 1 | 2 | 3 | 4 | 5 | 6 | 7 | 8 |
| Polybutadiene A | | 80 | 80 | 80 | 80 | 80 | 80 | 80 | 80 | 80 | 80 | 80 | |
| Polybutadiene B | | 20 | 20 | 20 | 20 | 20 | 20 | 20 | 20 | 20 | 20 | 20 | 20 |
| Polybutadiene C | | | | | | | | | | | | | 80 |
| Zinc acrylate | | 33.0 | 33.0 | 28.5 | 31.0 | 28.5 | 25.5 | 28.5 | 25.5 | 33.0 | 33.0 | 38.5 | 33.0 |
| Peroxide (1) | | 1 | 1 | 1 | 1 | 0 | 0 | 0 | 0 | 1 | 1 | 1 | 0.75 |
| Peroxide (2) | | 0 | 0 | 0 | 0 | 2.5 | 2.5 | 2.5 | 2.5 | 0 | 0 | 0 | 0 |
| Water | | 0.8 | 0.8 | 0 | 0 | 0 | 0 | 0 | 0 | 0.8 | 0.8 | 0.8 | 0 |
| Propylene glycol | | 0 | 0 | 1.0 | 1.5 | 0 | 0 | 0 | 0 | 0 | 0 | 0 | 0 |
| Antioxidant | | 0.1 | 0.1 | 0.1 | 0.1 | 0.1 | 0.1 | 0.1 | 0.1 | 0.1 | 0.1 | 0.1 | 0.2 |
| Barium sulfate (1) | | 17.3 | 17.3 | 19.4 | 18.3 | 0 | 0 | 0 | 0 | 17.3 | 17.3 | 15 | 0 |
| Barium sulfate (2) | | 0 | 0 | 0 | 0 | 18.2 | 19.5 | 18.2 | 19.5 | 0 | 0 | 0 | 0 |
| Zinc oxide | | 4 | 4 | 4 | 4 | 4 | 4 | 4 | 4 | 4 | 4 | 4 | 19.9 |
| Zinc stearate | | | | | | | | | | | | | 5.0 |
| Sulfur | | | | | | | | | | | | | 0.06 |
| Zinc salt of pentachlorothiophenol | | 0.6 | 0.6 | 0.6 | 0.6 | 0.4 | 0.5 | 0.4 | 0.5 | 0.6 | 0.6 | 0.6 | 0.4 |
| Vulcanization conditions | Temp. (° C.) | 157 | 157 | 157 | 157 | 157 | 157 | 157 | 157 | 157 | 157 | 157 | 155 |
| | Time (min) | 15 | 15 | 15 | 15 | 15 | 15 | 15 | 15 | 15 | 15 | 15 | 21 |

Details on the ingredients shown in Table 1 are given below.

Polybutadiene A: Available under the trade name "BR 01" from JSR Corporation

Polybutadiene B: Available under the trade name "BR 51" from JSR Corporation

Polybutadiene C: Available under the trade name "BR 730" from JSR Corporation

Zinc acrylate: Available from Nippon Shokubai Co., Ltd.

Peroxide (1): Dicumyl peroxide, available under the trade name "Percumyl D" from NOF Corporation Peroxide (2): A mixture of 1,1-di(t-butylperoxy)cyclohexane and silica, available under the trade name "Perhexa C-40" from NOF Corporation Propylene glycol (a lower dihydric alcohol): molecular weight, 76.1 (from Hayashi Pure Chemical Ind., Ltd.)

Antioxidant: 2,2'-Methylenebis(4-methyl-6-t-butylphenol), available under the trade name "Nocrac NS-6" from Ouchi Shinko Chemical Industry Co., Ltd.

Barium sulfate (1): Available under the trade name "Barico #300" from Hakusui Tech Barium sulfate (2): Available as "Precipitated Barium Sulfate #100" from Sakai Chemical Co., Ltd.

Zinc oxide: Available under the trade name "Zinc Oxide Grade 3" from Sakai Chemical Co., Ltd.

Zinc stearate: Available under the trade name "Zinc Stearate G" from NOF Corporation Sulfur: Available under the trade name "Sulfax-5" from Tsurumi Chemical Industry Co., Ltd.

Zinc salt of pentachlorothiophenol: Available from ZHEJIANG CHO & FU CHEMICAL

Formation of Intermediate Layer and Cover

Figure 2:
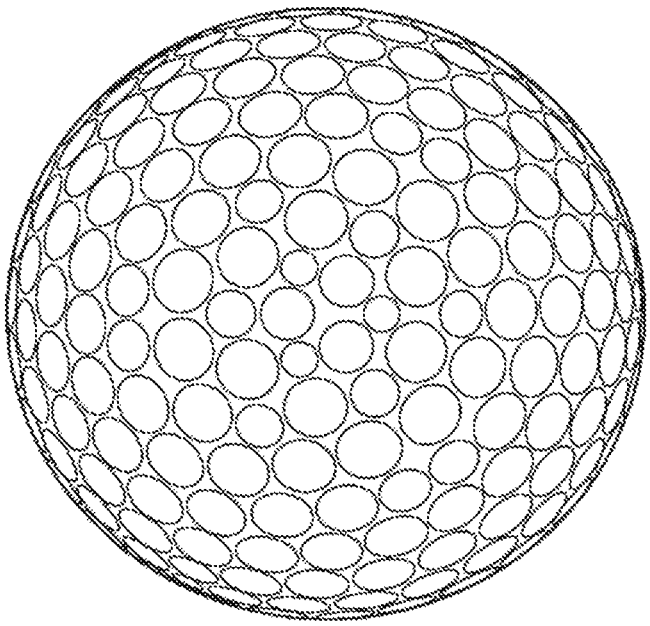
FIG. 2 is a top view of a golf ball showing the dimple pattern used in the examples of the invention.

An intermediate layer material formulated as shown in Table 2 was injected-molded over the core obtained above to form an intermediate layer. Next, using the cover materials formulated as shown in Table 2, a cover (outermost layer) was injection-molded over the resulting intermediate layer-encased sphere, thereby producing a golf ball having an intermediate layer and a cover (outermost layer) over the core. The dimples shown in FIG. 2 were formed at this time on the cover surface. Details on the dimples are given in Table 3.

TABLE 2

| Resin materials (pbw) | I | II | III | IV | V | VI | VII |
|---|---|---|---|---|---|---|---|
| T-8295 | | | 75 | | 100 | | |
| T-8290 | | | 25 | 75 | | | |
| T-8283 | | | | 25 | | | |
| HPF 2000 | | | | | | 100 | |
| Himilan 1706 | | 35 | | | | | 15 |
| Himilan 1557 | | 15 | | | | | |
| Himilan 1605 | | 50 | | | | | |
| AM 7318 | | | | | | | 70 |
| AM 7329 | | | | | | | 15 |
| AN 4319 | 20 | | | | | | |
| AN 4221C | 80 | | | | | | |
| Hytrel 4001 | | | 11 | 11 | 11 | | |
| Titanium oxide | | | 3.9 | 3.9 | 3.9 | | |
| Polyethylene wax | | | 1.2 | 1.2 | 1.2 | | |
| Isocyanate compound | | | 7.5 | 7.5 | 7.5 | | |
| Trimethylolpropane | | 1.1 | | | | 1.1 | |
| Magnesium stearate | 60 | | | | | | |
| Calcium hydroxide | 1.5 | | | | | | |
| Magnesium oxide | 1 | | | | | | |
| Polytail H | 8 | | | | | | |

Details on the materials shown in Table 2 are as follows.

T-8295, T-8290, T-8283: MDI-PTMG type thermoplastic polyurethanes available from DIC Bayer Polymer under the trademark Pandex.

HPF 2000: Available from E.I. DuPont de Nemours & Co. as "HPF™ 2000"

Himilan: Ionomers available from DuPont-Mitsui Polychemicals Co., Ltd.

AM 7318, AM 7329: Ionomers available from DuPont-Mitsui Polychemicals Co., Ltd. The acid content of the ionomer of AM 7318 is 18 wt %.

AN 4319, AN 4221C: Available under the trade name "Nucrel" from DuPont-Mitsui Polychemicals Co., Ltd.

Hytrel 4001: A polyester elastomer available from DuPont-Toray Co., Ltd.

Polyethylene wax: Available as "Sanwax 161P" from Sanyo Chemical industries, Ltd.

Isocyanate compound: 4,4'-Diphenylmethane diisocyanate

Polytail H: Available from Mitsubishi Chemical Corporation

TABLE 3

| No. | Number of dimples | Diameter (mm) | Depth (mm) | $V_0$ | SR (%) | VR (%) |
|---|---|---|---|---|---|---|
| 1 | 12 | 4.6 | 0.15 | 0.47 | 81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of the surface area of a hypothetical sphere were the ball to have no dimples on the surface thereof.

VR: Sum of spatial volumes of individual dimples formed below flat plane circumscribed by the edge of a dimple, as a percentage of the volume of a hypothetical sphere were the ball to have no dimples on the surface thereof.

The following measurements and evaluations were carried out on the golf balls obtained as described above. The results are shown in Tables 4-I and 4-II.

Diameters of Core and Intermediate Layer-Encased Sphere

The diameters at five random places on the surface of a core or an intermediate layer-encased sphere were measured at a temperature of 23.9±1° C. and, using the average of these measurements as the measured value for a single core or intermediate layer-encased sphere, the average diameter for five measured cores or intermediate layer-encased spheres was determined.

Diameter of Ball (Cover-Encased Sphere)

The diameters at five random dimple-free places (lands) on the surface of a ball were measured at a temperature of 23.9±1° C. and, using the average of these measurements as the measured value for a single ball, the average diameter for five measured balls was determined.

Deflections of Core, Intermediate Layer-Encased Sphere and Ball

The core, intermediate layer-encased sphere or ball was placed on a hard plate and the amount of deflection when compressed under a final load of 1,275 N (130 kgf) from an initial load of 98 N (10 kgf) was measured for each. The amount of deflection here refers to the measured value obtained after holding the test specimen isothermally at 23.9° C.

Center Hardness (JIS-C Hardness) of Core (Cc)

The hardness at the center of the cross-section obtained by cutting the core in half through the center was measured. Measurement was carried out with the spring-type durometer (JIS-C model) specified in JIS K 6301-1975.

Surface Hardness (JIS-C Hardness) of Core (Cs)

Measurements were taken by pressing the durometer indenter perpendicularly against the surface of the spherical core. The JIS-C hardness was measured with the spring-type durometer (JIS-C model) specified in JIS K 6301-1975.

Cross-Sectional Hardnesses (JIS-C Hardnesses) at Specific Positions of Core (1) To determine the cross-sectional hardness at a position 5 mm from the core center (C5), a core was cut in half through the center and the hardness at a position 5 mm from the center of the resulting cross-section was measured with the spring-type durometer (JIS-C model) specified in JIS K 6301-1975.

(2) To determine the cross-sectional hardness at a position midway between the core surface and center, a core was cut in half through the center and the hardness at a position midway between the center and surface of the resulting cross-section was measured with the above durometer (JIS-C model).

Surface Hardnesses (Shore D Hardnesses) of Intermediate Layer-Encased Sphere and Ball (Cover-Encased Sphere)

Measurements were taken by pressing the durometer indenter perpendicularly against the surface of the intermediate layer-encased sphere or the ball (cover). The surface hardness of the ball (cover-encased sphere) is the measured value obtained at dimple-free places (lands) on the ball surface. The Shore D hardnesses were measured with a type D durometer in accordance with ASTM D2240-95.

Material Hardnesses (Shore D Hardnesses) of Intermediate Layer and Cover

The resin materials for, respectively, the intermediate layer and the cover were formed into sheets having a thickness of 2 mm and left to stand for at least two weeks, following which the Shore D hardnesses were measured in accordance with ASTM D2240-95.

Initial Velocities of Various Layer-Encased Spheres

The initial velocities were measured using an initial velocity measuring apparatus of the same type as the USGA drum rotation-type initial velocity instrument approved by the R&A. The cores, intermediate layer-encased spheres and balls (cover-encased spheres) (referred to below as "spherical test specimens") were held isothermally in a 23.9±1° C. environment for at least 3 hours, and then tested in a chamber at a room temperature of 23.9±2C. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

TABLE 4

| | | Example | | | | Comparative Example | | |
|---|---|---|---|---|---|---|---|---|
| | | 1 | 2 | 3 | 4 | 1 | 2 | 3 |
| | Construction | 3-piece | 3-piece | 3-piece | 3-piece | 3-piece | 3-piece | 3-piece |
| Core | Diameter (mm) | 37.7 | 37.7 | 37.7 | 37.7 | 37.7 | 37.7 | 37.7 |
| | Weight (g) | 32.9 | 32.9 | 32.9 | 32.9 | 32.7 | 32.7 | 32.7 |
| | Specific gravity | 1.17 | 1.17 | 1.17 | 1.17 | 1.17 | 1.17 | 1.17 |
| | Deflection (mm) | 4.40 | 4.40 | 4.42 | 4.39 | 3.78 | 4.19 | 3.78 |
| | Initial velocity (m/s) | 77.62 | 77.62 | 77.71 | 77.61 | 77.83 | 77.77 | 77.83 |
| Hardness profile of core (JIS-C) | Surface hardness (Cs) | 81.0 | 81.0 | 78.5 | 79.4 | 81.5 | 78.6 | 81.5 |
| | Hardness at position midway between surface and center (Cm) | 58.5 | 58.5 | 60.2 | 62.1 | 68.9 | 65.6 | 68.9 |
| | Hardness at position 5 mm from center (C5) | 58.3 | 58.3 | 58.4 | 58.5 | 68.9 | 64.9 | 68.9 |
| | Center hardness (Cc) | 55.5 | 55.5 | 55.7 | 54.1 | 60.9 | 58.9 | 60.9 |
| | Surface hardness − Center hardness (Cs − Cc) | 25.5 | 25.5 | 22.8 | 25.3 | 20.6 | 19.7 | 20.6 |
| | Cs − Cm | 22.5 | 22.5 | 18.3 | 17.3 | 12.6 | 13.0 | 12.6 |
| | Cm − Cc | 3.0 | 3.0 | 4.5 | 8.0 | 8.0 | 6.7 | 8.0 |
| | C5 − Cc | 2.8 | 2.8 | 2.7 | 4.4 | 8.0 | 6.0 | 8.0 |
| | (Cs − Cc)/(Cm − Cc) | 8.5 | 8.5 | 5.1 | 3.2 | 2.6 | 2.9 | 2.6 |
| | (Cs − Cc)/(C5 − Cc) | 9.1 | 9.1 | 8.4 | 5.8 | 2.6 | 3.3 | 2.6 |
| Surface hardness of core (Ds), Shore D | | 54 | 54 | 52 | 52 | 54 | 52 | 54 |
| Intermediate layer | Material (type) | II | VII | VII | VII | I | I | II |
| | Thickness (mm) | 1.66 | 1.66 | 1.66 | 1.66 | 1.66 | 1.68 | 1.67 |
| | Specific gravity | 0.95 | 0.95 | 0.95 | 0.95 | 0.96 | 0.95 | 0.95 |
| | Sheet (material hardness), Shore D | 62 | 65 | 65 | 65 | 55 | 55 | 62 |
| Intermediate layer-encased sphere | Diameter (mm) | 41.0 | 41.0 | 41.0 | 41.0 | 41.0 | 41.0 | 41.0 |
| | Weight (g) | 40.7 | 40.7 | 40.7 | 40.7 | 40.4 | 40.5 | 40.4 |
| | Deflection (mm) | 3.36 | 3.25 | 3.27 | 3.24 | 3.27 | 3.69 | 3.03 |
| | Initial velocity (m/s) | 77.98 | 78.22 | 78.30 | 78.21 | 77.98 | 77.90 | 78.06 |
| | Surface hardness (Shore D) | 69 | 72 | 72 | 72 | 62 | 62 | 69 |
| Surface hardness of intermediate layer − Surface hardness of core (Shore D) | | 15 | 18 | 20 | 20 | 8 | 10 | 15 |
| Initial velocity of intermediate layer-encased sphere − Core initial velocity (m/s) | | 0.36 | 0.60 | 0.59 | 0.60 | 0.15 | 0.13 | 0.23 |
| Core deflection − Deflection of intermediate layer-encased sphere (mm) | | 1.04 | 1.15 | 1.15 | 1.15 | 0.51 | 0.50 | 0.74 |
| Cover | Material (type) | IV | IV | IV | IV | III | III | IV |
| | Thickness (mm) | 0.84 | 0.84 | 0.84 | 0.84 | 0.84 | 0.84 | 0.84 |
| | Specific gravity | 1.11 | 1.11 | 1.11 | 1.11 | 1.11 | 1.11 | 1.11 |
| | Sheet (material hardness), Shore D | 47 | 47 | 47 | 47 | 53 | 53 | 47 |
| Ball | Diameter (mm) | 42.7 | 42.7 | 42.7 | 42.7 | 42.7 | 42.7 | 42.7 |
| | Weight (g) | 45.5 | 45.5 | 45.5 | 45.5 | 45.4 | 45.4 | 45.3 |
| | Deflection (mm) | 3.08 | 2.97 | 3.09 | 3.07 | 2.93 | 3.28 | 2.75 |
| | Initial velocity (m/s) | 77.10 | 77.25 | 77.32 | 77.24 | 77.20 | 77.10 | 77.19 |
| | Surface hardness (Shore D) | 55 | 56 | 56 | 56 | 61 | 61 | 55 |
| Core surface hardness − Ball surface hardness (Shore D) | | −1 | −2 | −4 | −4 | −7 | −9 | −1 |
| Ball surface hardness − Intermediate layer surface hardness (Shore D) | | −14 | −16 | −16 | −16 | −1 | −1 | −14 |
| Intermediate layer thickness − Cover thickness (mm) | | 0.82 | 0.82 | 0.81 | 0.82 | 0.82 | 0.84 | 0.83 |
| Core deflection − Ball deflection (mm) | | 1.33 | 1.43 | 1.33 | 1.32 | 0.84 | 0.92 | 1.03 |
| Ball initial velocity − Core initial velocity (m/s) | | −0.52 | −0.37 | −0.39 | −0.37 | −0.63 | −0.67 | −0.64 |
| Ball initial velocity − Intermediate layer-encased sphere initial velocity (m/s) | | −0.88 | −0.97 | −0.98 | −0.97 | −0.78 | −0.80 | −0.87 |

| | | Comparative Example | | | | |
|---|---|---|---|---|---|---|
| | | 4 | 5 | 6 | 7 | 8 |
| | Construction | 3-piece | 3-piece | 3-piece | 3-piece | 3-piece |
| Core | Diameter (mm) | 37.7 | 37.7 | 37.7 | 37.7 | 37.7 |
| | Weight (g) | 32.7 | 32.9 | 32.9 | 32.9 | 32.9 |
| | Specific gravity | 1.17 | 1.17 | 1.17 | 1.18 | 1.17 |
| | Deflection (mm) | 4.19 | 4.40 | 4.40 | 3.77 | 3.50 |
| | Initial velocity (m/s) | 77.77 | 77.62 | 77.62 | 77.62 | 77.60 |
| Hardness profile of core (JIS-C) | Surface hardness (Cs) | 78.6 | 81.0 | 81.0 | 86.2 | 81.6 |
| | Hardness at position midway between surface and center (Cm) | 65.6 | 58.5 | 58.5 | 63.6 | 65.0 |
| | Hardness at position 5 mm from center (C5) | 64.9 | 58.3 | 58.3 | 61.6 | 64.2 |
| | Center hardness (Cc) | 58.9 | 55.5 | 55.5 | 58.3 | 64.2 |
| | Surface hardness − Center hardness (Cs − Cc) | 19.7 | 25.5 | 25.5 | 27.9 | 17.4 |
| | Cs − Cm | 13.0 | 22.5 | 22.5 | 22.6 | 16.6 |
| | Cm − Cc | 6.7 | 3.0 | 3.0 | 5.3 | 0.8 |

TABLE 4-continued

| | | | | | | |
|---|---|---|---|---|---|---|
| | C5 − Cc | 6.0 | 2.8 | 2.8 | 3.3 | 0.0 |
| | (Cs − Cc)/(Cm − Cc) | 2.9 | 8.5 | 8.5 | 5.3 | 21.8 |
| | (Cs − Cc)/(C5 − Cc) | 3.3 | 9.1 | 9.1 | 8.5 | — |
| Surface hardness at core (Ds), Shore D | | 52 | 54 | 54 | 58 | 54 |
| Intermediate layer | Material (type) | II | II | I | VI | II |
| | Thickness (mm) | 1.68 | 1.20 | 1.66 | 1.67 | 1.70 |
| | Specific gravity | 0.95 | 0.95 | 0.95 | 0.96 | 0.95 |
| | Sheet (material hardness), Shore D | 62 | 62 | 55 | 48 | 62 |
| Intermediate layer-encased sphere | Diameter (mm) | 41.0 | 40.1 | 41.0 | 41.0 | 41.1 |
| | Weight (g) | 40.5 | 38.4 | 40.6 | 40.7 | 40.8 |
| | Deflection (mm) | 3.38 | 3.50 | 3.70 | 3.40 | 2.90 |
| | Initial velocity (m/s) | 77.99 | 77.88 | 77.78 | 77.42 | 77.90 |
| | Surface hardness (Shore D) | 69 | 69 | 62 | 55 | 69 |
| Surface hardness of intermediate layer − Surface hardness of core (Shore D) | | 17 | 15 | 8 | −3 | 15 |
| Initial velocity of intermediate layer-encased sphere − Core initial velocity (m/s) | | 0.22 | 0.26 | 0.16 | −0.20 | 0.30 |
| Core deflection − Deflection of intermediate layer-encased sphere (mm) | | 0.81 | 0.90 | 0.70 | 0.37 | 0.60 |
| Cover | Material (type) | IV | IV | V | III | IV |
| | Thickness (mm) | 0.84 | 1.30 | 0.84 | 0.84 | 0.80 |
| | Specific gravity | 1.11 | 1.11 | 1.11 | 1.11 | 1.11 |
| | Sheet (material hardness), Shore D | 47 | 47 | 56.5 | 53 | 47 |
| Ball | Diameter (mm) | 42.7 | 42.7 | 42.7 | 42.7 | 42.7 |
| | Weight (g) | 45.3 | 45.9 | 45.6 | 45.7 | 45.5 |
| | Deflection (mm) | 3.13 | 3.20 | 3.17 | 3.23 | 2.70 |
| | Initial velocity (m/s) | 77.10 | 76.80 | 77.06 | 76.92 | 77.20 |
| | Surface hardness (Shore D) | 55 | 53 | 63 | 59 | 55 |
| Core surface hardness − Ball surface hardness (Shore D) | | −3 | 1 | −9 | −1 | −1 |
| Ball surface hardness − Intermediate layer surface hardness (Shore D) | | −14 | −16 | 1 | 4 | −14 |
| Intermediate layer thickness − Cover thickness (mm) | | 0.85 | −0.10 | 0.82 | 0.83 | 0.90 |
| Core deflection − Ball deflection (mm) | | 1.07 | 1.20 | 1.23 | 0.54 | 0.80 |
| Ball initial velocity − Core initial velocity (m/s) | | −0.67 | −0.82 | −0.56 | −0.70 | −0.40 |
| Ball initial velocity − Intermediate layer-encased sphere initial velocity (m/s) | | −0.89 | −1.08 | −0.72 | −0.50 | −0.70 |

The flight performance on shots with a driver (W #1), distance on shots with an iron (I #6), spin performance on approach shots, feel, and scuff resistance of the golf balls obtained in each of the Examples of the invention and the Comparative Examples were evaluated according to the following criteria. The results are shown in Table 5.

Flight Performance on Shots with a Driver

A driver (W #1) was mounted on a golf swing robot, the distance traveled by the ball when struck at a head speed (HS) of 45 m/s was measured, and the flight performance was rated according to the criteria shown below. The club used was a TourStage X-Drive 709 D430 driver (2013 model; loft angle, 9.5°) manufactured by Bridgestone Sports Co., Ltd. The above head speed corresponds to the average head speed of mid- and high-level amateur golfers.

Rating Criteria:

Good: Total distance was 232.0 m or more

NG: Total distance was less than 232.0 m

Flight Performance on Shots with an Iron

An iron (I #6) was mounted on a golf swing robot, the distance traveled by the ball when struck at a head speed (HS) of 40 m/s was measured, and the flight performance was rated according to the criteria shown below. The club used was a TourStage X-Blade 707 (2012 model) manufactured by Bridgestone Sports Co., Ltd.

Rating Criteria:

Good: Total distance was 170.0 m or more

NG: Total distance was less than 170.0 m

Spin Performance on Approach Shots

A sand wedge was mounted on a golf swing robot, and the spin rate of the ball when hit at a head speed (HS) of 35 m/s was rated according to the following criteria.

Rating Criteria:

Good: Spin rate was 5,700 rpm or more

NG: Spin rate was less than 5,700 rpm

Feel

Sensory evaluations were carried out when the balls were hit with a driver (W #1) by amateur golfers having head speeds of 40 to 50 m/s. The feel of the ball was rated according to the following criteria.

Good: Six or more out of ten golfers rated the feel as good

Fair: Three to five out of ten golfers rated the feel as good

NG: Two or fewer out of ten golfers rated the feel as good

Here, a "good feel" refers to a feel at impact that is appropriately soft.

Scuff Resistance

A non-plated pitching sand wedge was set in a swing robot and the ball was hit once at a head speed of 35 m/s, following which the surface state of the ball was visually examined and rated as follows.

Good: The ball was judged to be capable of use again.

NG: The ball was judged to no longer be capable of use.

TABLE 5

| | | | Example | | | | Comparative Example | | | | | | | |
|---|---|---|---|---|---|---|---|---|---|---|---|---|---|---|
| | | | 1 | 2 | 3 | 4 | 1 | 2 | 3 | 4 | 5 | 6 | 7 | 8 |
| Flight performance | W#1 HS, 45 m/s | Spin rate (rpm) | 2,945 | 2,938 | 2,955 | 2,899 | 2,878 | 2,813 | 3,129 | 3,009 | 3,040 | 2,603 | 2,964 | 2,869 |
| | | Total distance (m) | 232.0 | 232.6 | 232.1 | 234.4 | 232.3 | 231.6 | 230.6 | 229.1 | 229.2 | 234.9 | 231.4 | 233.5 |
| | | Rating | good | good | good | good | good | NG | NG | NG | NG | good | NG | good |
| | I#6 | Distance (m) | 170.7 | 172.2 | 171.8 | 170.8 | 168.2 | 171.4 | 166.6 | 169.5 | 169.2 | 174.1 | 166.8 | 167.9 |
| | | Rating | good | good | good | good | NG | good | NG | NG | NG | good | NG | NG |
| Performance on approach shots | Spin rate (rpm) | | 5,928 | 5,878 | 5,882 | 5,892 | 5,788 | 5,729 | 6,108 | 5,927 | 5,968 | 5,577 | 5,719 | 6,153 |
| | Rating | | good | good | good | good | good | good | good | good | good | NG | good | good |
| Feel | Rating | | good | good | good | good | good | good | good | good | good | good | good | fair |
| Scuff resistance | Rating | | good | good | good | good | good | good | good | good | good | NG | good | good |

In Comparative Examples 1 and 2, the hardness profile of the core falls outside the range of values in the present invention and the (initial velocity of intermediate layer-encased sphere−initial velocity of core) value is less than 0.2 m/s. As a result, the spin rate on shots with a W #1 and/or an iron was high, and the intended distance was not achieved.

In Comparative Examples 3 and 4, the hardness profile of the core falls outside the range of values in the present invention. As a result, the spin rate on shots with a W #1 and/or an iron was high, and the intended distance was not achieved.

In Comparative Example 5, the cover (outermost layer) was thicker than the intermediate layer. As a result, the spin rate of the ball on full shots was high and the intended distance was not achieved.

In Comparative Example 6, the surface hardness of the ball was higher than the surface hardness of the intermediate layer-encased sphere. As a result, the spin rate on approach shots was inadequate, in addition to which the scuff resistance was poor.

In Comparative Example 7, the surface hardness of the intermediate layer-encased sphere was lower than the surface hardness of the core, the surface hardness of the ball was higher than the surface hardness of the intermediate layer-encased sphere. And, the (initial velocity of intermediate layer-encased sphere−initial velocity of core) value is less than 0.2 m/s. As a result, the spin rate on fully shots was high, and the intended distance was not obtained.

In Comparative Example 8, the value obtained by subtracting the core center hardness from the core surface hardness, expressed in terms of JIS-C hardness, was smaller than 22 and the core center hardness is higher than 63 in JIS-C hardness. As a result, particularly on full shots with an iron, the spin rate rose, and so a good distance was not obtained. In addition, the ball had a somewhat hard feel.

Japanese Patent Application No. 2014-255269 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, a cover and an intermediate layer therebetween, wherein the core, a sphere composed of the core and the intermediate layer which peripherally encases the core (intermediate layer-encased sphere), and the ball have respective surface hardnesses, expressed in terms of Shore D hardness, which satisfy the relationship ball surface hardness≤surface hardness of intermediate layer-encased sphere≥core surface hardness;

and the intermediate layer and the cover have respective thicknesses which satisfy the relationship (thickness of intermediate layer−thickness of cover) ≥0; and the core has a hardness profile which, expressed in terms of JIS-C hardness, satisfies the following relationships:

core center hardness (Cc)≤63

22≤core surface hardness (Cs)−core center hardness (Cc),

5≥[hardness at a position 5 mm from core center (*C*5)−core center hardness (Cc)]>0, and

[core surface hardness (Cs)−core center hardness (Cc)]/[hardness at a position midway between core surface and core center (Cm)−core center hardness (Cc)]≥3.0; and the (initial velocity of intermediate layer-encased sphere−initial velocity of core) value is 0.20 m/s or above.

2. The multi-piece solid golf ball of claim 1, wherein the [hardness at a position midway between core surface and core center (Cm)−core center hardness (Cc)] value, expressed in terms of JIS-C hardness, is 6 or less.

3. The multi-piece solid golf ball of claim 1, wherein the [core surface hardness (Cs)−core center hardness (Cc)]/[hardness at a position 5 mm from core center (C5)−core center hardness (Cc)] value, is 4 or more.

4. The multi-piece solid golf ball of claim 1, wherein the (core surface hardness−ball surface hardness) value, expressed in terms of Shore D hardness, is in the range of −10 to 2.

5. The multi-piece solid golf ball of claim 1 which satisfies the relationship 0.7 mm≤E−B≤1.6 mm, wherein E is the deflection of the core when compressed under a final load of 1,275 N (130 kgf) from an initial load of 98 N (10 kgf) and B is the deflection of the ball when compressed under a final load of 1,275 N (130 kgf) from an initial load of 98 N (10 kgf).

6. The multi-piece solid golf ball of claim 1, wherein the initial velocities of the core, the intermediate layer-encased sphere and the ball satisfy the relationships:

$-0.1$ m/s≤ball initial velocity−core initial velocity≤1 m/s; and $-1.3$ m/s≤ball initial velocity−initial velocity of intermediate layer-encased sphere≤$-0.1$ m/s.

7. The multi-piece solid golf ball of claim 1, wherein the material of the intermediate layer includes an ionomer resin having a high acid content of at least 16 wt %.

8. The multi-piece solid golf ball of claim 1, wherein the core is formed of a rubber composition containing the following ingredients (a) to (d):

(a) a base rubber, (b) a co-crosslinking agent which is an α,β-unsaturated carboxylic acid or a metal salt thereof or both, (c) a crosslinking initiator, and (d) a lower alcohol having a molecular weight below 200.

9. The multi-piece solid golf ball of claim 8, wherein component (d) is included in an amount, per 100 parts by weight of the base rubber (a), of from 0.5 to 5 parts by weight.

10. The multi-piece solid golf ball of claim 8, wherein component (d) is a monohydric, dihydric or trihydric alcohol.

11. The multi-piece solid golf ball of claim 8, wherein component (d) is butanol, glycerol, ethylene glycol or propylene glycol.

12. The multi-piece solid golf ball of claim 1, wherein the intermediate layer has a material hardness, expressed in terms of Shore D hardness, of at least 60.

13. The multi-piece solid golf ball of claim 1, wherein the value obtained by subtracting the surface hardness of the intermediate layer-encased sphere from the surface hardness of the ball, expressed in terms of Shore D hardness, is −6 or below.

* * * * *